US011538644B2

(12) United States Patent
Chao

(10) Patent No.: US 11,538,644 B2
(45) Date of Patent: Dec. 27, 2022

(54) KEYSWITCH STRUCTURE

(71) Applicant: DARFON ELECTRONICS CORP., Taoyuan (TW)

(72) Inventor: Ling-Hsi Chao, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 16/820,653

(22) Filed: Mar. 16, 2020

(65) Prior Publication Data

US 2020/0328043 A1 Oct. 15, 2020

(30) Foreign Application Priority Data

Apr. 11, 2019 (TW) ..... 108112668
Jul. 9, 2019 (TW) ..... 108124078

(51) Int. Cl.
*H01H 13/14* (2006.01)
*H01H 13/10* (2006.01)

(52) U.S. Cl.
CPC ..... *H01H 13/14* (2013.01); *H01H 13/10* (2013.01)

(58) Field of Classification Search
CPC ..... H01H 13/14; H01H 13/10; H01H 3/125; H01H 3/122; H01H 13/7065; H01H 13/705; H01H 13/83; H01H 13/70; H01H 2215/006; H01H 2215/004; H01H 2237/00; H01H 13/52; H01H 13/20; H01H 2227/028; H01H 13/704; H01H 13/7006; H01H 13/26; H01H 13/7057; H01H 13/78; H01H 13/79; H01H 13/703; H01H 13/507; H01H 2227/036
USPC ..... 200/341, 344, 345
See application file for complete search history.

(56) References Cited

U.S. PATENT DOCUMENTS

| | | | | |
|---|---|---|---|---|
| 6,455,794 | B2 | 9/2002 | Sato | |
| 6,586,695 | B2 | 7/2003 | Sato | |
| 8,299,382 | B2 | 10/2012 | Takemae | |
| 8,642,904 | B2 | 2/2014 | Chiba | |
| 9,842,710 | B2 * | 12/2017 | Maruyama | H01H 3/125 |
| 9,916,943 | B2 * | 3/2018 | Lin | H01H 3/122 |
| 10,184,609 | B2 * | 1/2019 | Yen | H01H 13/70 |
| 10,475,598 | B2 * | 11/2019 | Chang | H01H 3/122 |
| 10,867,759 | B2 * | 12/2020 | Chao | H01H 3/125 |
| 2008/0185279 | A1 | 8/2008 | Lin | |
| 2009/0078552 | A1 | 3/2009 | Takemae | |

(Continued)

FOREIGN PATENT DOCUMENTS

| | | | |
|---|---|---|---|
| CN | 101625936 | A | 1/2010 |
| CN | 101661846 | A | 3/2010 |

(Continued)

*Primary Examiner* — Lheiren Mae A Caroc
(74) *Attorney, Agent, or Firm* — Winston Hsu

(57) ABSTRACT

A keyswitch structure includes a keycap, a base, and two supports that are pivotally connected to each other and connected to and between the keycap and the base. The keycap can move up and down relative to the base through the two supports. In an embodiment, the two supports are pivotally connected through an engagement of a shaft with a C-shaped shaft hole. In another embodiment, each support is provided in a form of an n-shaped structure and includes a semi-shaft hole and a shaft portion at two ends of the n-shaped structure respectively. The two supports are pivotally connected by the shaft portions rotatably abutting the corresponding semi-shaft holes.

10 Claims, 11 Drawing Sheets

(56) References Cited

U.S. PATENT DOCUMENTS

| | | | | |
|---|---|---|---|---|
| 2011/0024278 | A1* | 2/2011 | Wang | H01H 3/125 200/5 A |
| 2012/0118715 | A1 | 5/2012 | Lin | |
| 2012/0228107 | A1* | 9/2012 | Funakoshi | H01H 13/36 200/532 |
| 2012/0292168 | A1 | 11/2012 | Chiba | |
| 2013/0078023 | A1 | 3/2013 | Yamada | |
| 2014/0116865 | A1 | 5/2014 | Leong | |
| 2017/0365422 | A1 | 12/2017 | Watanabe | |
| 2021/0012983 | A1* | 1/2021 | Chao | H01H 13/7065 |

FOREIGN PATENT DOCUMENTS

| | | | |
|---|---|---|---|
| CN | 202678165 | U | 1/2013 |
| CN | 102969183 | A | 3/2013 |
| CN | 104269307 | A | 1/2015 |
| CN | 104769529 | A | 7/2015 |
| CN | 104576136 | B | 7/2017 |
| CN | 207052506 | U | 2/2018 |
| CN | 207925325 | U | 9/2018 |
| CN | 108878182 | A | 11/2018 |
| CN | 109314006 | A | 2/2019 |
| JP | 11-288638 | A | 10/1999 |
| TW | 539177 | | 6/2003 |
| TW | 201104717 | A1 | 2/2011 |
| TW | 201611064 | A | 3/2016 |
| TW | 201640545 | A | 11/2016 |
| TW | 201705171 | A | 2/2017 |
| TW | 201735079 | A | 10/2017 |
| TW | 201735085 | A | 10/2017 |
| TW | I643225 | B | 12/2018 |
| TW | I646567 | B | 1/2019 |

* cited by examiner

KEYSWITCH STRUCTURE

BACKGROUND OF THE INVENTION

1. Field of the Invention

The present invention relates to a mechanical keyswitch structure, and more particularly to a mechanical keyswitch structure, of which the keycap is supported by and is movable through two supports.

2. Description of the Prior Art

Many mechanical keyswitch structures use a scissors support to support its keycap. The two supports of the scissors support are usually pivotally connected through a complete hole and a complete shaft formed at middle portions of the two supports fitting with each other. The hole-shaft fit can provide good relative rotation stability for the supports. However, if the two supports are pivotally connected through a complete hole-shaft structure, the two supports usually need to be assembled together along the pivot axis, or need to cross at a specific angle so as to be assembled. For automatic assembly, the above assembly ways make it difficult to adjust processes and design jigs, and even to avoid excessively scraping due to misalignment, which also will affect the yield and production capacity.

U.S. Pat. No. 6,060,676 discloses two supports, of which arm distal ends have a toothed structure, respectively. The two supports are connected by meshing the two toothed structures. During a pressing operation on a keyswitch having the two supports, the engagement of the toothed structures will produce engagement and disengagement of the teeth thereof many times, which increases the instability of the keycap of the keyswitch during the pressing operation. Furthermore, in the engagement of the two toothed structures, only a few of teeth located at the zone, where the toothed structures mesh with each other, are engaged. The distal ends of the supports are still unrestricted in multiple directions. This structural configuration also will reduce the stability of the keycap.

Furthermore, when the whole keyswitch structure is reduced in size, it is difficult for the supports to provide enough space for forming a complete hole-shaft structure. Even though a complete hole-shaft structure is formed, the structural strength thereof may probably be insufficient, resulting in a reduction of the stability of the pivotal connection of the supports. Furthermore, in general, a complete hole-shaft structure may cause permanent deformation or damage to the supports during assembly. When the whole keyswitch structure is reduced in size, the permanent deformation or damage probably influences the strength of the supports and the engagement stability thereof, and further influences the action stability of the keyswitch structure.

SUMMARY OF THE INVENTION

The present disclosure provides a keyswitch structure, of which supports are connected by a shaft with a C-shaped shaft hole or a shaft portion with a semi-hole.

A keyswitch structure according to an embodiment includes a keycap, a base, a first support, and a second support. The base is disposed under the keycap. The first support is connected to and between the keycap and the base. The first support includes a shaft. The second support is connected to and between the keycap and the base. The second support includes a C-shaped shaft hole. The first support and the second support are pivotally connected relative to a rotation axis by the shaft fitting in the C-shaped shaft hole. The C-shaped shaft hole has an opening. An opening direction of the opening is perpendicular to the rotation axis. The keycap is up and down movable through the first support and the second support relative to the base.

A keyswitch structure according to another embodiment includes a keycap, a base, a first support, and a second support. The base is disposed under the keycap. The first support is connected to and between the keycap and the base and shows a first n-shaped structure. The first support includes a first keycap connection portion and a shaft portion. The first support is rotatably connected to the keycap through the first keycap connection portion. The shaft portion is located at a distal end of the first n-shaped structure. The second support is connected to and between the keycap and the base and shows a second n-shaped structure. The second support includes a second keycap connection portion and a semi-shaft hole. The second support is rotatably connected to the keycap through the second keycap connection portion. The semi-shaft hole is located at a distal end of the second n-shaped structure. The first support and the second support are pivotally connected relative to a rotation axis by the shaft portion rotatably abutting against the semi-shaft hole. The keycap is up and down movable through the first support and the second support relative to the base.

Compared with the prior art, the keyswitch structure according to the invention uses an incomplete hole-shaft structure and thereby can maintain the structural strength of the supports. The above pivotal connection of the shaft with the C-shaped shaft hole produces structural elasticity during assembly and restriction in all directions, which can maintain both the structural strength of the pivotal connection and the rotation stability, so as to prevent the supports from permanent deformation or damage during assembly. In the above pivotal connection of the shaft portion with the semi-shaft hole, the projection of the sliding contact surface of the two supports onto a plane perpendicular to the rotation axis can show a segment of continuous arc required for the rotation of the supports. Besides, the pivotal connection of the shaft portion with the semi-shaft hole also has a restriction design both along the rotation axis and in the vertical direction. Thereby, the pivotal connection of the shaft portion with the semi-shaft hole still can maintain the structural strength of the pivotal connection and the rotation stability in a certain degree. For the both pivotal connections, the two supports of the keyswitch structure according to the invention have the high stable pivotal connection configuration and can be horizontally and automatically in an end-to-end manner, so that the lifting stroke of the keycap can have better track stability.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
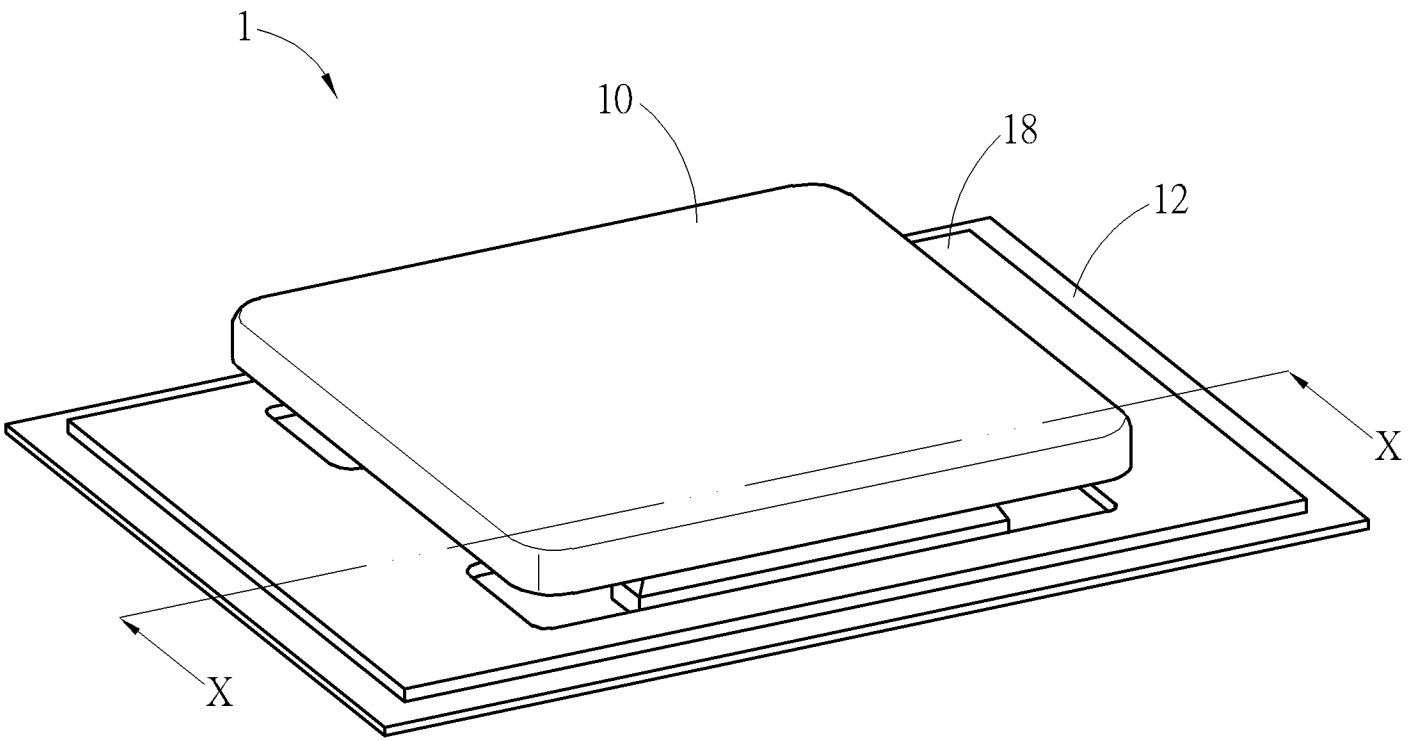
FIG. 1 is a schematic diagram illustrating a keyswitch structure according to an embodiment.
Figure 2:
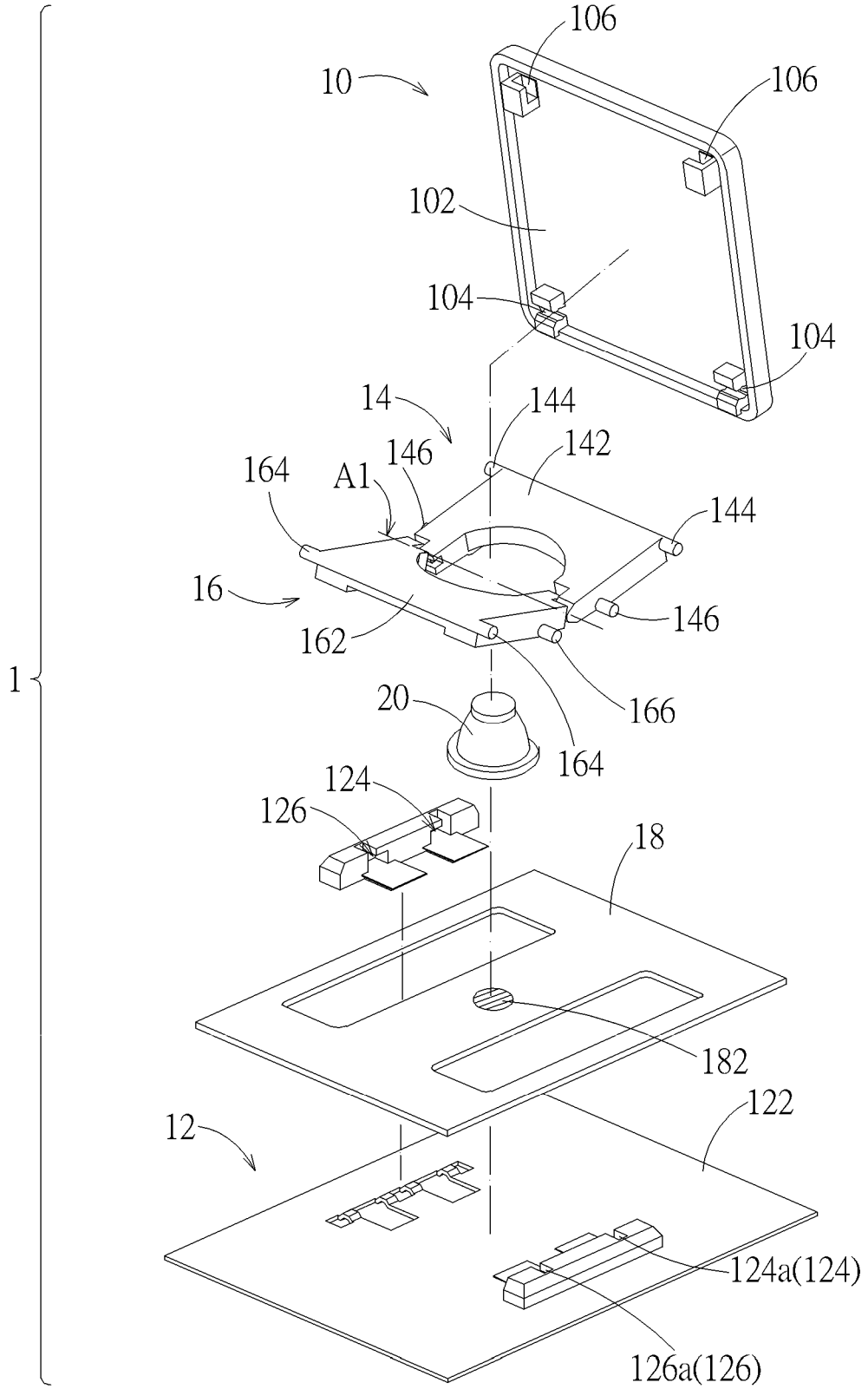
FIG. 2 is a partially exploded view of the keyswitch structure in FIG. 1.

Please refer to FIG. 1 and FIG. 2. A keyswitch structure 1 according to an embodiment includes a keycap 10, a base 12, a first support 14, a second support 16, a switch circuit board 18, and a resilient restoration part 20. The base 12 is disposed under the keycap 10. The first support 14 and the second support 16 are pivotally connected with each other relative to a rotation axis A1 (indicated by a chain line in FIG. 2) and respectively are connected to and between the keycap 10 and base 12. The switch circuit board 18 is disposed on the base 12. The resilient restoration part 20 is disposed on the switch circuit board 18 corresponding to a switch 182 (indicated by a circle with hatched lines in FIG. 2) of the switch circuit board 18. The keycap 10 can vertically move up and down relative to the base 12 through the first support 14 and the second support 16. When moving downward, the keycap 10 can press the resilient restoration part 20 to trigger the switch 182. In practice, the switch circuit board 18 can be but not limited to a common membrane circuit board, of which the structure details will not be described in addition. For simplification of drawing, the switch circuit board 18 is shown by a single solid part. The resilient restoration part 20 can be but not limited to a silicone or rubber dome.

Figure 3:
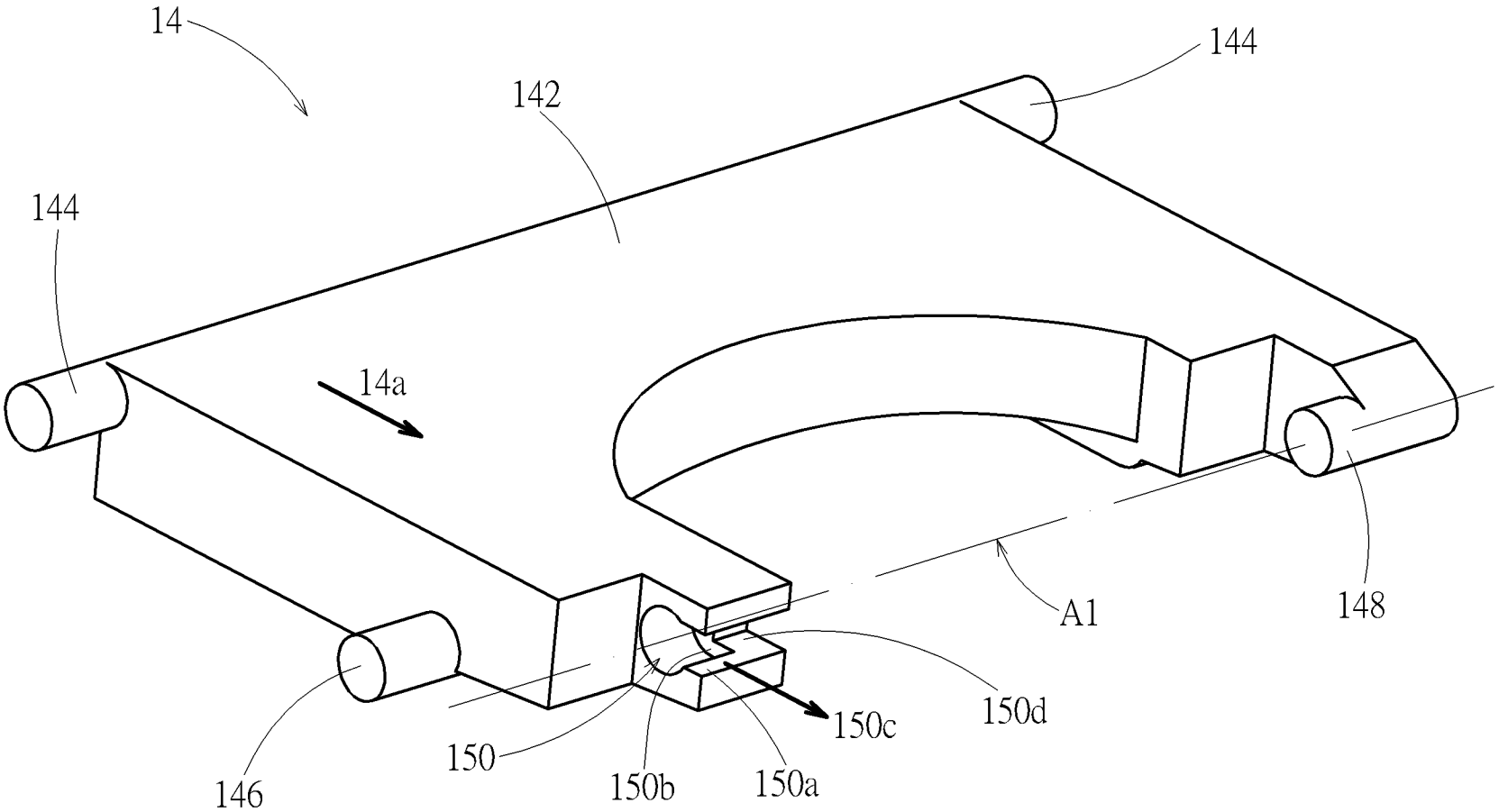
FIG. 3 is a schematic diagram illustrating a first support of the keyswitch structure in FIG. 2.
Figure 4:
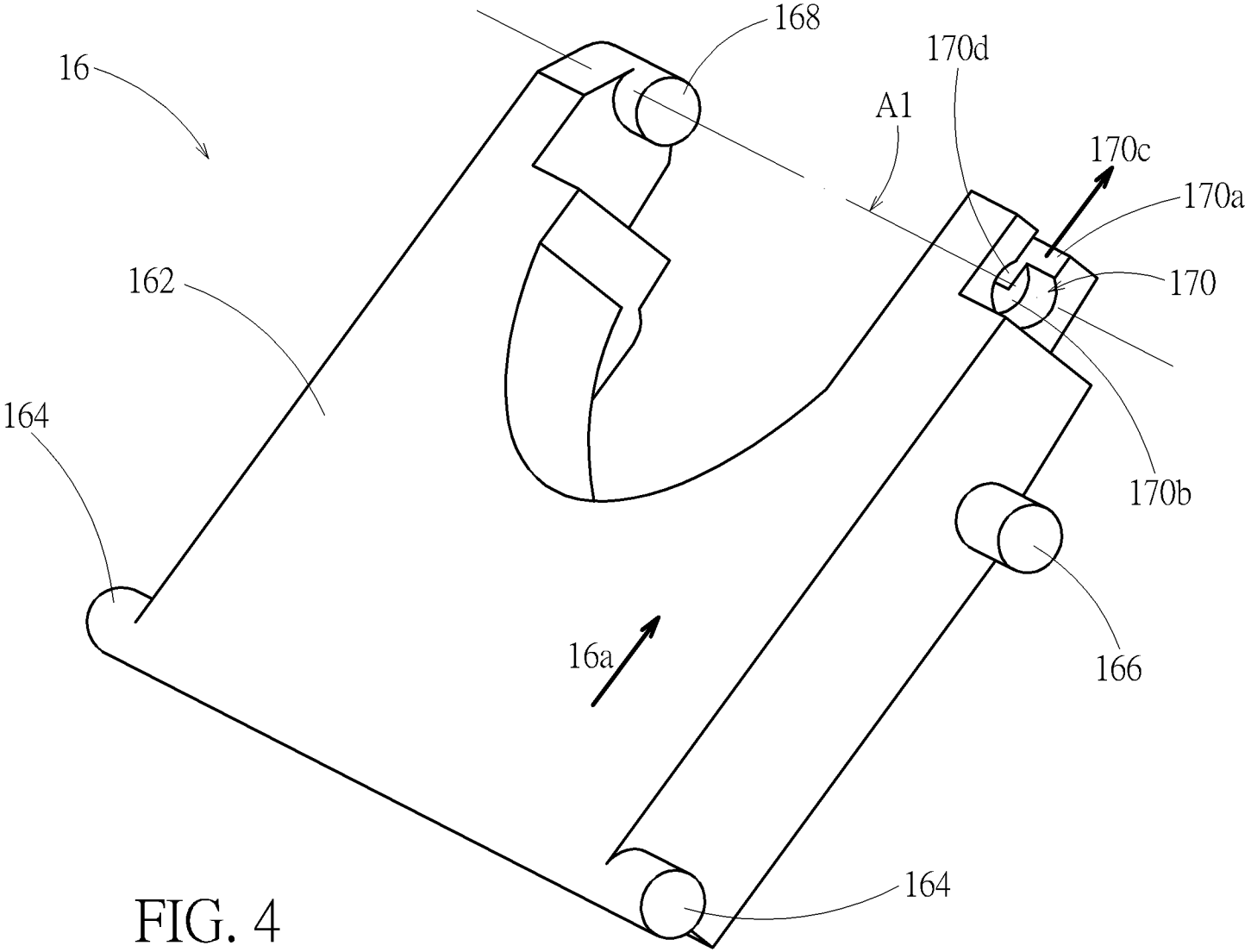
FIG. 4 is a schematic diagram illustrating a second support of the keyswitch structure in FIG. 2.

Please also refer to FIG. 3 and FIG. 4. In the embodiment, the keycap 10 includes a cap body 102 and two first support connection portions 104 and two second support connection portions 106 that are disposed on the cap body 102. The base 12 includes a base plate 122 and two first sliding slots 124 and two second sliding slots 126 that are disposed on the base plate 122. The first support 14 includes a first support body 142 and two first keycap connection portions 144, two first base connection portions 146, a first shaft 148, and a first C-shaped shaft hole 150 that are disposed on the first support body 142. The first support body 142 shows a first n-shaped structure. The two first keycap connection portions 144 and the two first base connection portions 146 at two opposite sides of the first n-shaped structure relative a direction perpendicular to the rotation axis Al. The two first base connection portion 146 are located outside of the two end portions of the first n-shaped structure respectively (or, in other embodiments, located at the inner side of the first n-shaped structure according to the disposition of the first sliding slots 124). The first shaft 148 and the first C-shaped shaft hole 150 are located at the two end portions respectively and extend along the rotation axis Al. The first shaft 148 and the first C-shaped shaft hole 150 coaxially coincide, that is, the coaxial axis thereof coinciding with the rotation axis Al, which is conducive to the rotation stability of the first support 14. The first base connection portion 146 is located between the first shaft 148 (or the first C-shaped shaft hole 150) and the first keycap connection portion 144. The first C-shaped shaft hole 150 is located at the end portion of one arm of the n-shaped structure and has a first opening 150*a* and an incomplete round trough surface (extending along the rotation axis Al). The opening direction 150*c* (indicated by an arrow in FIG. 3) of the first opening 150*a* is perpendicular to the rotation axis Al. The first support 14 and the keycap 10 are rotatably connected through the first keycap connection portion 144 and the first support connection portion 104. Therein, the first support connection portion 104 shows a shaft hole structure. The first keycap connection portion 144 is shows a post structure that extends parallel to the rotation axis Al from the first support body 142 and is pivotally connected to the first support connection portion 104. The first support 14 and the base 12 are rotatably connected through the first base connection portion 146 and the first sliding slot 124. Therein, the first sliding slot 124 extends parallel to the base plate 122 and perpendicular to the rotation axis Al. The first base connection portion 146 shows a post structure that extends parallel to the rotation axis Al from the first support body 142 and is rotatably and slidably disposed in the first sliding slot 124.

The second support 16 includes a second support body 162 and two second keycap connection portions 164, two second base connection portions 166, a second shaft 168, and a second C-shaped shaft hole 170 that are disposed on the second support body 162. The second support body 162 shows a second n-shaped structure. The two second keycap connection portion 164 and the two second base connection portions 166 respectively are located at two opposite sides of the second n-shaped structure. The two second base connection portions 166 are located outside of the two end portions of the second n-shaped structure respectively (or, in other embodiments, located at the inner side of the first n-shaped structure according to the disposition of the second sliding slots 126). The second shaft 168 and the second C-shaped shaft hole 170 are located at the two end portions respectively and extend along the rotation axis Al. The second shaft 168 and the second C-shaped shaft hole coaxially coincide, that is, the coaxial axis thereof coinciding with the rotation axis Al, which is conducive to the rotation stability of the second support 16. The second base connection portion 166 is located between the second shaft 168 (or the second C-shaped shaft hole 170) and the second keycap connection portion 164. The second C-shaped shaft hole 170 is located at the end portion of one arm of the n-shaped structure and has a second opening 170*a* and an incomplete round trough surface (extending along the rotation axis Al). The opening direction 170*c* (indicated by an arrow in FIG. 4) of the second opening 170*a* is perpendicular to the rotation axis Al. The second support 16 and the keycap 10 are rotatably connected through the second keycap connection portion 164 and the second support connection portion 106. Therein, the second support connection portion 106 shows a sliding slot structure. The second keycap connection portion 164 shows a post structure that extends parallel to the rotation axis Al from the second support body 162 and is rotatably and slidably disposed in the second support connection portion 106. The second support 16 and the base 12 are rotatably connected through the second base connection portion 166 and the second sliding slot 126. Therein, the second sliding slot 126 extends parallel to the base plate 122 and perpendicular to the rotation axis Al. The second base connection portion 166 shows a post structure that extends parallel to the rotation axis Al from the second support body 162 and is rotatably and slidably disposed in the second sliding slot 126. The first support 14 and the second support 16 are pivotally connected relative to the rotation axis Al by the first shaft 148 fitting in the second C-shaped shaft hole 170 and the second shaft 168 fitting in the first C-shaped shaft hole 150. By the contact and restriction by the incomplete round trough surfaces of the second C-shaped shaft hole 170 and the first C-shaped shaft hole 150 in multiple rotation directions, the first shaft 148 and the second shaft 168 can rotate smoothly and stably under high pivoting strength. Therein, in the top view of the keyswitch structure 1, the first support 14 and the second support 16 are connected to form a rectangle structure. The resilient restoration part 20 passes through the rectangle structure to abut against the keycap 10. In the side view of the keyswitch structure 1, when the keycap 10 is not pressed, the first support 14 and the second support 16 are connected to form a V-shaped structure.

In the embodiment, the first C-shaped shaft hole 150 and the second C-shaped shaft hole 170 are elastically deformable due to the presence of the breach structure (the first opening 150*a*/the second opening 170*a*), so that the second shaft 168 and the first shaft 148 can fit in the first C-shaped shaft hole 150 and the second C-shaped shaft hole 170 through the first opening 150*a* and the second opening 170*a* respectively. The sizes of the first opening 150*a* and the second opening 170*a* can be set to be smaller than the shaft diameters of the second shaft 168 and the first shaft 148 (or the hole diameters of the first C-shaped shaft hole 150 and the second C-shaped shaft hole 170) respectively, for example, about two-thirds or a half of the shaft diameter for balancing the operation of the second shaft 168 and the first shaft 148 fitting in the first C-shaped shaft hole 150 and the second C-shaped shaft hole 170 respectively and the constraint effect of the first C-shaped shaft hole 150 and the second C-shaped shaft hole 170 to the second shaft 168 and the first shaft 148. Furthermore, as shown by FIG. 3, the first C-shaped shaft hole 150 has a bottom 150*b* in the rotation axis Al. The bottom 150*b* can be realized by a side wall structure extending perpendicular to the rotation axis Al and located at a side of the first opening 150*a* in the rotation axis Al. An indentation 150*d* is formed on the bottom 150*b* and passes through the bottom 150*b* in the rotation axis Al. The first opening 150*a* extends parallel to the rotation axis Al and connects with the indentation 150*d*. Thereby, the bottom 150*b* can enhance the structural strength of the first C-shaped shaft hole 150 and constrains the second shaft 168 along the rotation axis Al, which is conducive to the holding effect of the first C-shaped shaft hole 150 to the second shaft 168. Furthermore, that the first opening 150*a* connecting with the indentation 150*d* can avoid or reduce the influence of the bottom 150*b* to the operation of fitting the second shaft 168 in the first C-shaped shaft hole 150. In another embodiment, the holding effect of the first C-shaped shaft hole 150 to the second shaft 168 and the structural strength of the C-shaped shaft hole 150 can be maintained by fine-adjusting the size of the first opening 150*a* and the thickness of the bottom 150*b*. However, in practice, it is unnecessary to form the indentation 150*d* on the bottom 150*b*. Furthermore, similar to the first C-shaped shaft hole 150, the second C-shaped shaft hole 170 has a bottom 170*b* in the rotation axis Al. The bottom 170*b* can be realized by a side wall structure extending perpendicular to the rotation axis Al and located at a side of the second opening 170*a* in the rotation axis Al. An indentation 170*d* is formed on the bottom 170*b* and passes through the bottom 170*b* in the rotation axis Al. The second opening 170*a* extends parallel to the rotation axis Al and connects with the indentation 170*d*. For descriptions about the effect of the bottom 170*b* and variants thereof, please refer to the above relevant descriptions of the bottom 150*b*, which will not be described in addition.

Figure 5:
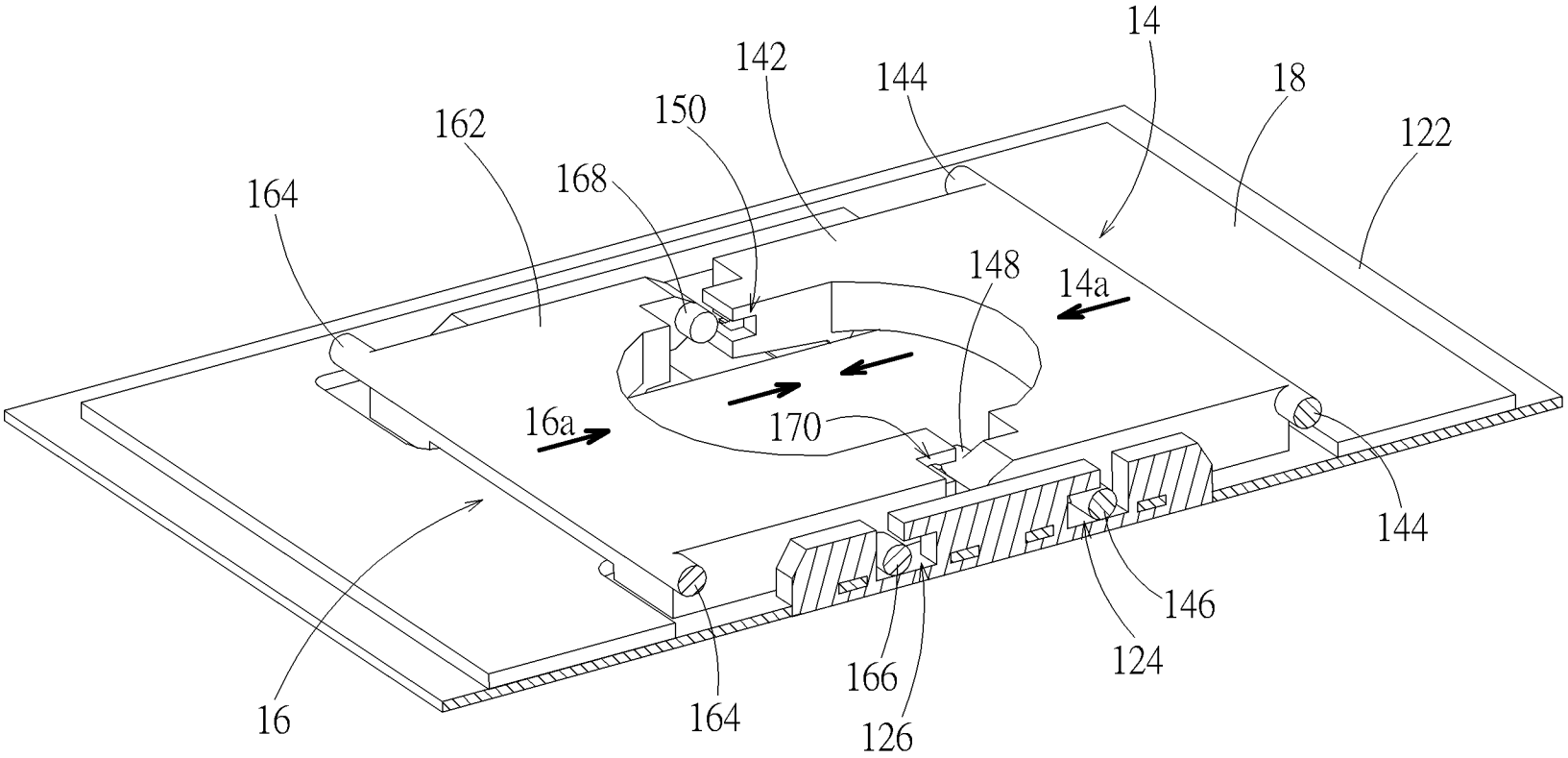
FIG. 5 is a sectional view illustrating a horizontal assembly of the first support and the second support in FIG. 2, of which the position of the cutting plane is indicated by the line X-X in FIG. 1.
Figure 6:
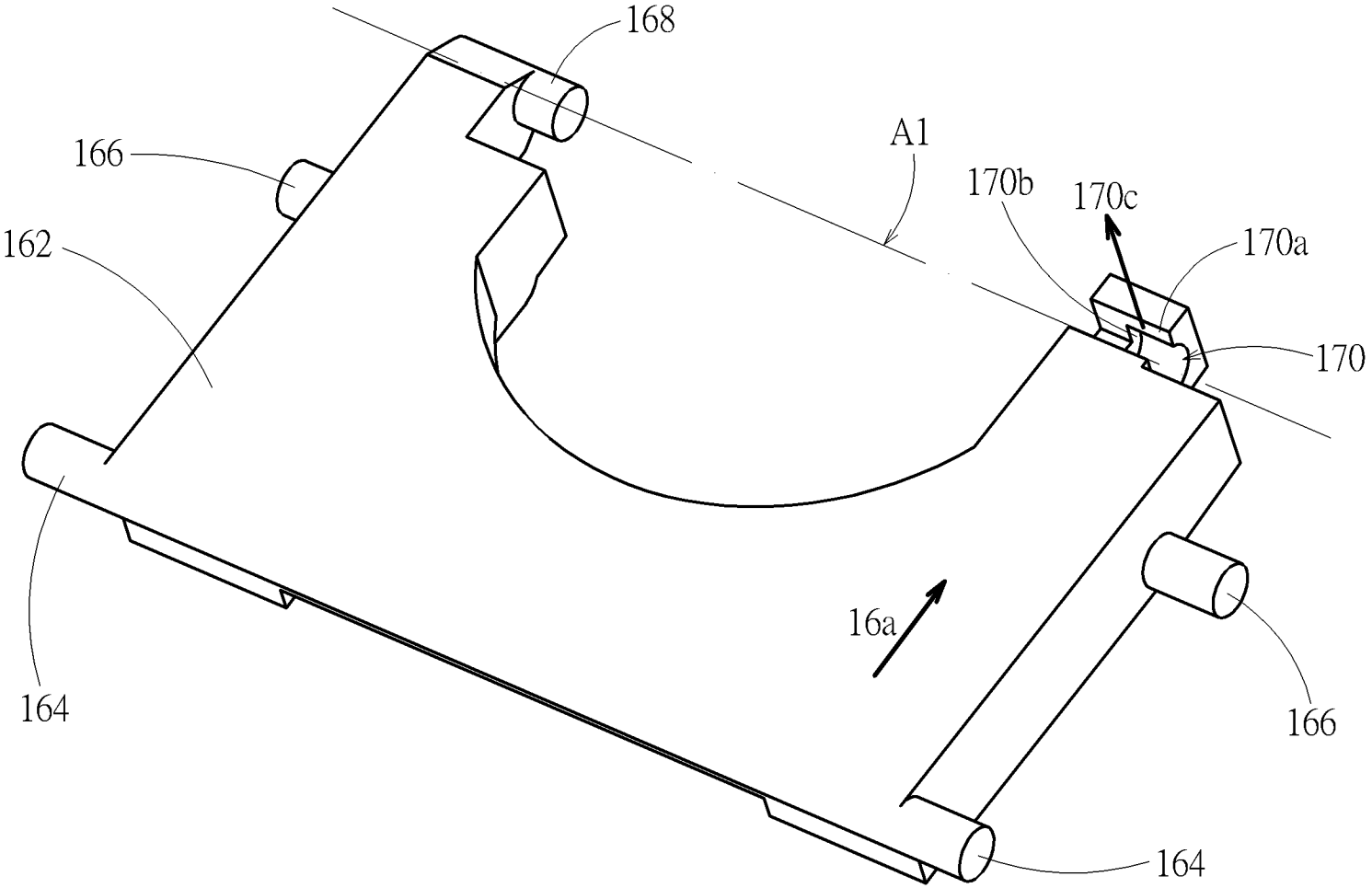
FIG. 6 is a schematic diagram illustrating the second support according to another embodiment.

In the embodiment, as shown by FIG. 2, the first sliding slot 124 extends parallel to the base plate 122 and has a first inlet 124*a*. The second sliding slot 126 extends parallel to the base plate 122 and has a second inlet 126*a*. As shown by FIG. 3, a first extension direction 14*a* (indicated by an arrow in FIG. 3, i.e. the direction the two side arms of the first support 14 point in) is defined as pointing from the first keycap connection portion 144 to the first base connection portion 146. The opening direction 150*c* of the first opening 150*a* is substantially parallel to the first extension direction 14*a* (i.e. the first opening 150*a* being toward the second support 16). As shown by FIG. 4, a second extension direction 16*a* (indicated by an arrow in FIG. 4, i.e. the direction the two side arms of the second support 16 point in) is defined as pointing from the second keycap connection portion 164 to the second base connection portion 166. The opening direction 170*c* of the second opening 170*a* is substantially parallel to the second extension direction 16*a* (i.e. the second opening 170*a* being toward the first support 14). Thereby, when assembling the first support 14 and the second support 16 to the base 12, the first base connection portion 146 and the second base connection portion 166 can be first put in the first sliding slot 124 and the second sliding slot 126 through the first inlet 124*a* and the second inlet 126*a* respectively. Then, the first support 14 and the second support 16 can be horizontally end-to-end (i.e. ends of the side arms thereof) assembled by jigs and automation equipment so as to achieve the pivotal connection of the first support 14 and the second support 16. As shown by FIG. 5, the first shaft 148 and the second shaft 168 are horizontally aligned with the second opening 170*a* and the first opening 150*a* respectively (e.g. simply by horizontally placing the first support 14 and the second support 16). Then, the first support 14 and the second support 16 are horizontally end-to-end moved (i.e. end portions of side arms thereof being opposite to each other) to approach each other (i.e. parallel to the first extension direction 14*a* and the second extension direction 16*a*, i.e. perpendicular to the rotation axis Al) until the first shaft 148 fits in the second C-shaped shaft hole 170 through the second opening 170*a* and the second shaft 168 fits in the first C-shaped shaft hole 150 through the first opening 150*a*; thereby, the pivotal connection of the first support 14 and the second support 16 is completed. The first shaft 148, the second C-shaped shaft hole 170, the second shaft 168 and the first C-shaped shaft hole 150 coaxially coincide, that is, the coaxial axis thereof coinciding with the rotation axis Al, which is conducive to the rotation stability of the first support 14 and the second support 16. Accordingly, the first base connection portion 146 and the second base connection portion 166 are slidably disposed in the first sliding slot 124 and the second sliding slot 126 respectively. In practice, the first support 14 and the second support 16 can be pivotally connected with each other and then be engaged with the base 12. For the latter, for example, the first support 14 and the second support 16 are compressed and deformed along the rotation axis Al so that the first base connection portion 146 and the second base connection portion 166 can enter the first sliding slot 124 and the second sliding slot 126 respectively; in this case, the first sliding slot 124 and the second sliding slot 126 are not limited to have the first inlet 124*a* and the second inlet 126*a*. In addition, in practice, the opening direction 150*c* of the first opening 150*a* is not limited to be parallel to the first extension direction 14*a*; the second opening 170*a* is not limited to be parallel to the second extension direction 16*a*. For example, the opening direction 170*c* of the second opening 170*a* is substantially perpendicular to the second extension direction 16*a* (i.e. disposed upward, as shown by FIG. 6), or the opening direction 170*c* of the second opening 170*a* and the second extension direction 16*a* form other included angle.

Furthermore, in the embodiment, as shown by FIG. 2, one plastic part structurally integrates one first sliding slot 124 and one second sliding slot 126. The plastic part can be joined to the base plate 122 (e.g. but not limited to a metal plate) by insert molding, or the plastic part can be formed by injection molding and then joined with the base plate 122 by riveting (e.g. by heating and shaping posts of the plastic part that pass through the base plate 122). In another embodiment, the first sliding slot 124 and the second sliding slot 126 are structurally integrated into the base plate 122. For example, the base plate 122 is realized by a metal plate, of which a portion is bent to form the first sliding slot 124 and the second sliding slot 126 (e.g. but not limited thereto by stamping).

In addition, in the embodiment, the first support 14 and the second support 16 have the same structure, which can reduce the production cost of the keyswitch structure 1; however, it is not limited thereto in practice. For example, the first support 14 includes two C-shaped shaft holes; the second support 16 includes two shafts correspondingly. Therein, the first support 14 and the second support 16 also can be pivotally connected with each other by this structural configuration. Even when the first support 14 and the second support 16 have the same structure, for the same support, its shaft and hole can extend in the same direction (e.g. the first shaft 148 extending along the rotation axis A1 toward the lower left corner of FIG. 3, and the axial opening direction of the first C-shaped shaft hole 150 being also toward the lower left corner of FIG. 3, in the same direction as the first shaft 148; similarly, the second shaft 168 extending along the rotation axis A1 toward the lower right corner of FIG. 4, the second C-shaped shaft hole 170 being also toward the lower right corner of FIG. 4, in the same direction as the second shaft 168), or can extend in opposite directions (e.g. the first shaft 148 extending along the rotation axis A1 toward the lower left corner of FIG. 3, and the axial opening direction of the first C-shaped shaft hole 150 being toward the upper right corner of FIG. 3, i.e. toward the first shaft 148, so that the first C-shaped shaft hole 150 and the first shaft 148 extend toward each other; similarly, the second shaft 168 extending along the rotation axis A1 toward the lower right corner of FIG. 4, the second C-shaped shaft hole 170 being toward the upper left corner of FIG. 4, i.e. toward the second shaft 168, so that the second C-shaped shaft hole 170 and the second shaft 168 extend toward each other). In addition, in the embodiment, both sides of the first support 14 and the second support 16 are connected to the keycap 10 and the base 12, so in practice, it is practicable to pivotally connect the first support 14 and the second support 16 through single side (e.g. the first support 14 and the second support 16 are pivotally connected only through the first shaft 148 and the second C-shaped shaft hole 170; therein, the first support 14 and the second support 16 respectively show an L-shaped structure), which still can maintain the linkage stability in a certain degree.

Figure 7A:
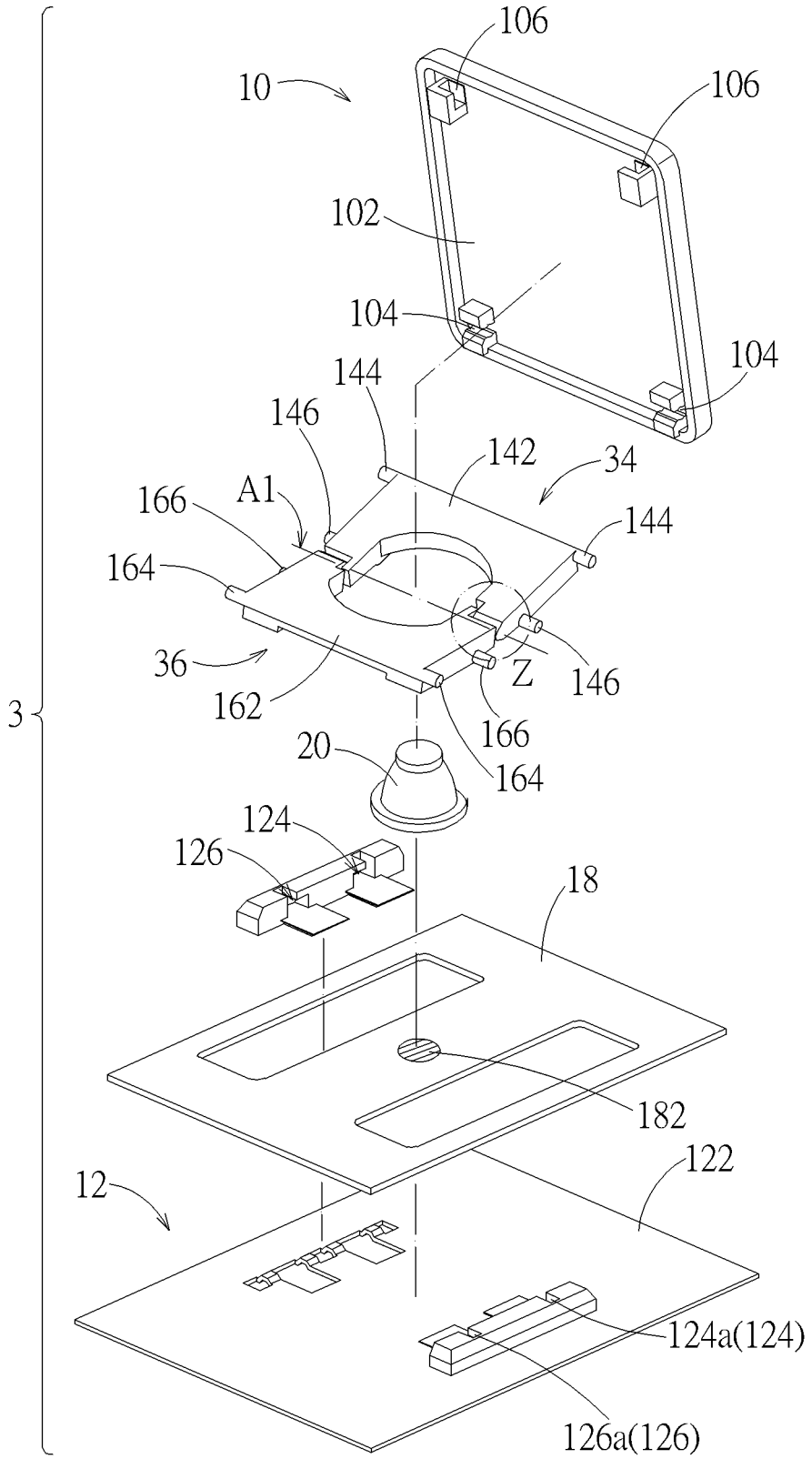
FIG. 7A is a partially exploded view of a keyswitch structure according to another embodiment
Figure 7B:
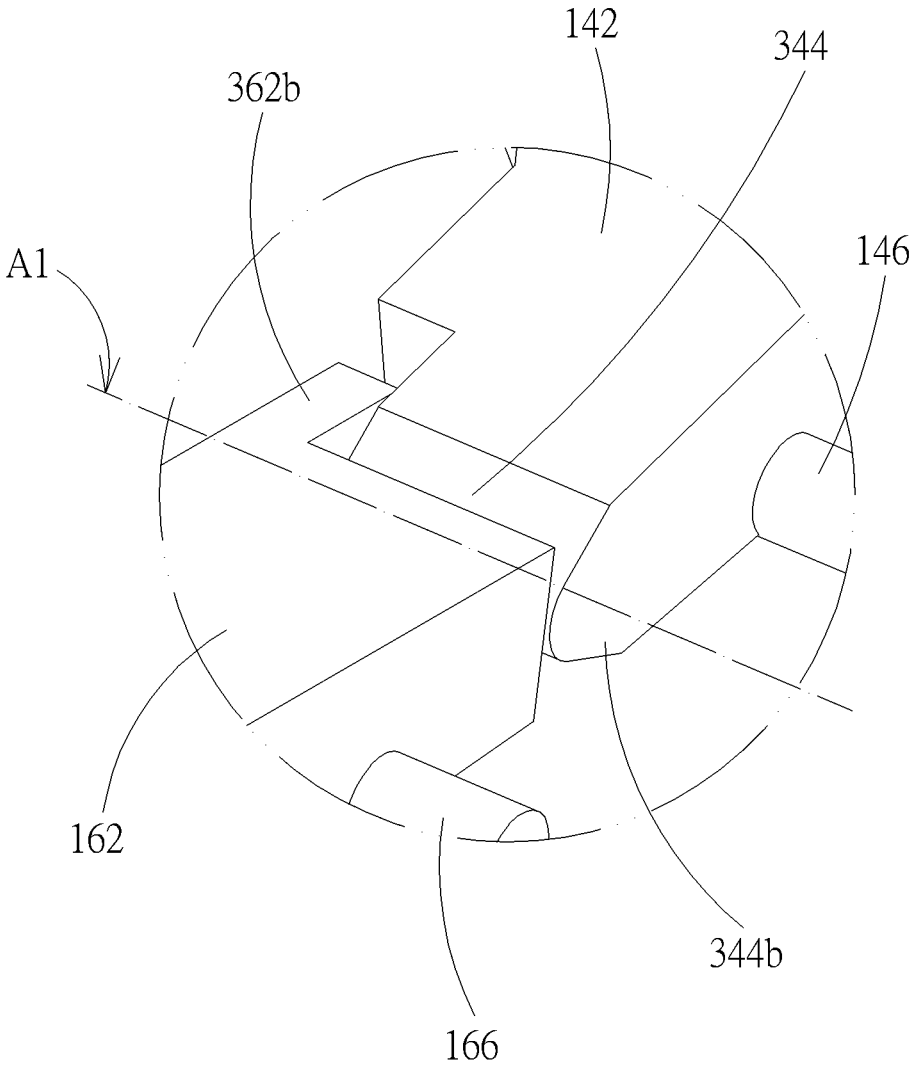
FIG. 7B is an enlarged view of the circle Z in FIG. 7A.
Figure 8:
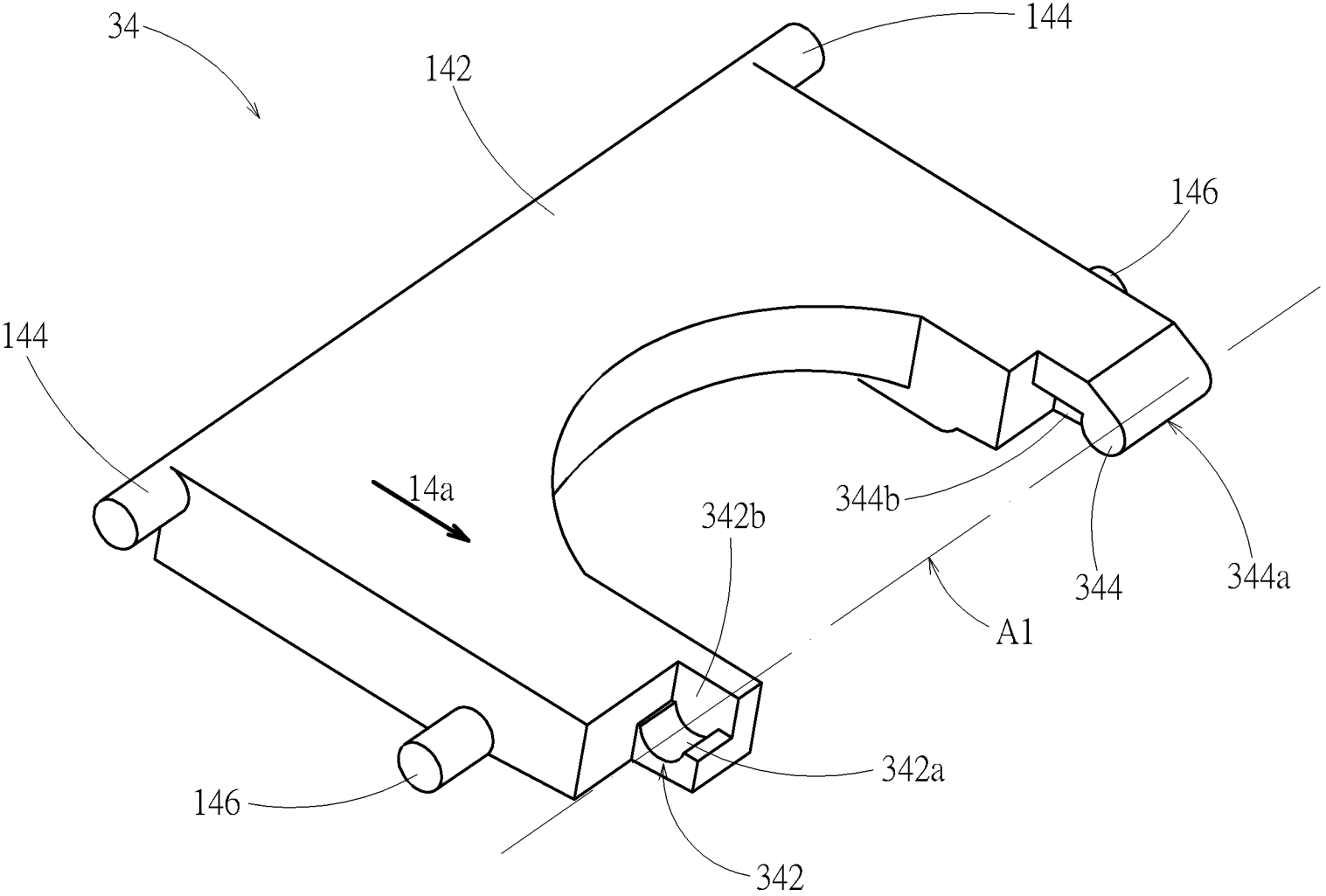
FIG. 8 is a schematic diagram illustrating a first support of the keyswitch structure in FIG. 7.
Figure 9:
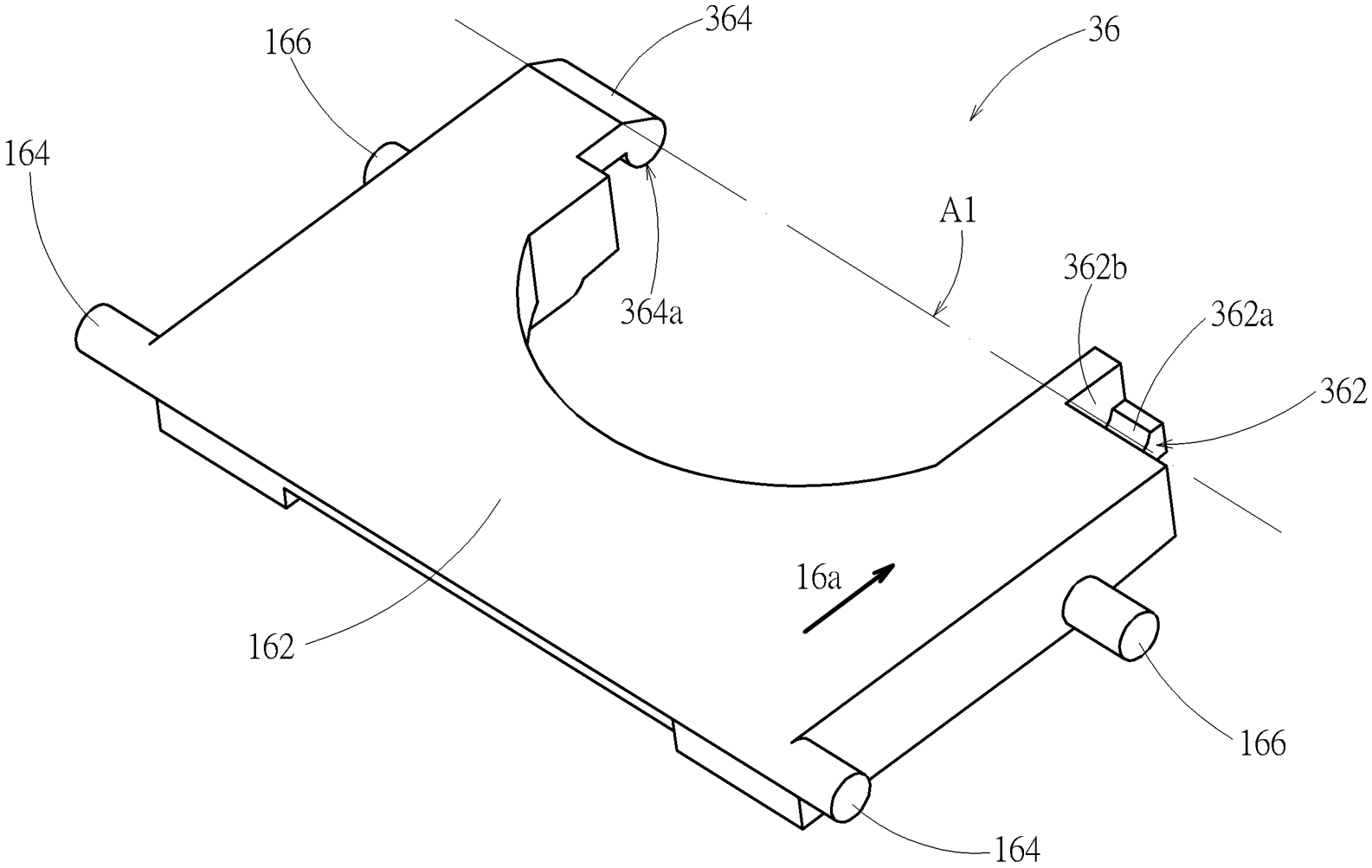
FIG. 9 is a schematic diagram illustrating a second support of the keyswitch structure in FIG. 7.

Please refer to FIG. 7 to FIG. 9. A keyswitch structure 3 according to another embodiment is structurally similar to the keyswitch structure 1 and uses the reference numbers of the keyswitch structure 1 in principle. For other descriptions about the keyswitch structure 3, please refer to the above relevant descriptions of the keyswitch structure 1 and variants thereof, which will not be described in addition. In the keyswitch structure 3, the first support 34 includes a first semi-shaft hole 342 and a first shaft portion 344, which are disposed at two distal ends of the first n-shaped structure. The second support 36 includes a second semi-shaft hole 362 and a second shaft portion 364, which are disposed at two distal ends of the second n-shaped structure. The first support 34 and the second support 36 are pivotally connected relative to the rotation axis A1 (indicated by a chain line in the figures) by the first shaft portion 344 rotatably abutting against the second semi-shaft hole 362 and the second shaft portion 364 rotatably abutting against the first semi-shaft hole 342. The keycap 10 can move up and down relative to the base 12 through the first support 34 and the second support 36.

Furthermore, in the embodiment, the first semi-shaft hole 342 has a semicircle recess surface 342*a* extending along the rotation axis A1. From another aspect, the semicircle recess surface 342*a* is equivalent to a concave surface extending along the rotation axis A1 and surrounding at a center angle of about 180 degrees relative to the rotation axis A1. The first shaft portion 344 is directly connected to the first support body 142 in a direction perpendicular to the rotation axis A1 and includes an incomplete cylinder surface 344*a* extending along the rotation axis A1. Correspondingly, the second semi-shaft hole 362 has a semicircle recess surface 362*a* extending along the rotation axis A1; therein, the semicircle recess surface 362*a* is equivalent to a concave surface extending along the rotation axis A1 and surrounding at a center angle of about 180 degrees relative to the rotation axis A1. The second shaft portion 364 is directly connected to the second support body 162 in a direction perpendicular to the rotation axis A1 and includes an incomplete cylinder surface 364*a* extending along the rotation axis A1. The first shaft portion 344 rotatably abuts against the second semi-shaft hole 362 by the incomplete cylinder surface 344*a* slidably contacting the semicircle recess surface 362*a*; the second shaft portion 364 rotatably abuts against the first semi-shaft hole 342 by the incomplete cylinder surface 364*a* slidably contacting the semicircle recess surface 342*a*.

The assembly therefor can be implemented by a method similar to the assembly of the above embodiment shown by FIG. 5, which is a horizontally end-to-end assembly implemented by jigs and automation equipment. The first shaft portion 344 and the second shaft portion 364 are aligned with the second semi-shaft hole 362 and the first semi-shaft hole 342 respectively (e.g. simply by horizontally placing the first support 34 and the second support 36). Then, the first support 34 and the second support 36 are horizontally moved (i.e. perpendicular to the rotation axis A1) in a way of the distal ends of the first n-shaped structure toward the distal ends of the second n-shaped structure so as to approach each other, until the first shaft portion 344 slides over the distal end protrusion of the second semi-shaft hole 362 (that is forced to be slightly deformed) to fit in the second semi-shaft hole 362, and the second shaft portion 364 slides over the distal end protrusion of the first semi-shaft hole 342 (that is forced to be slightly deformed) to fit in the first semi-shaft hole 342; thereby, the pivotal connection of the first support 34 and the second support 36 is completed.

Figure 10:
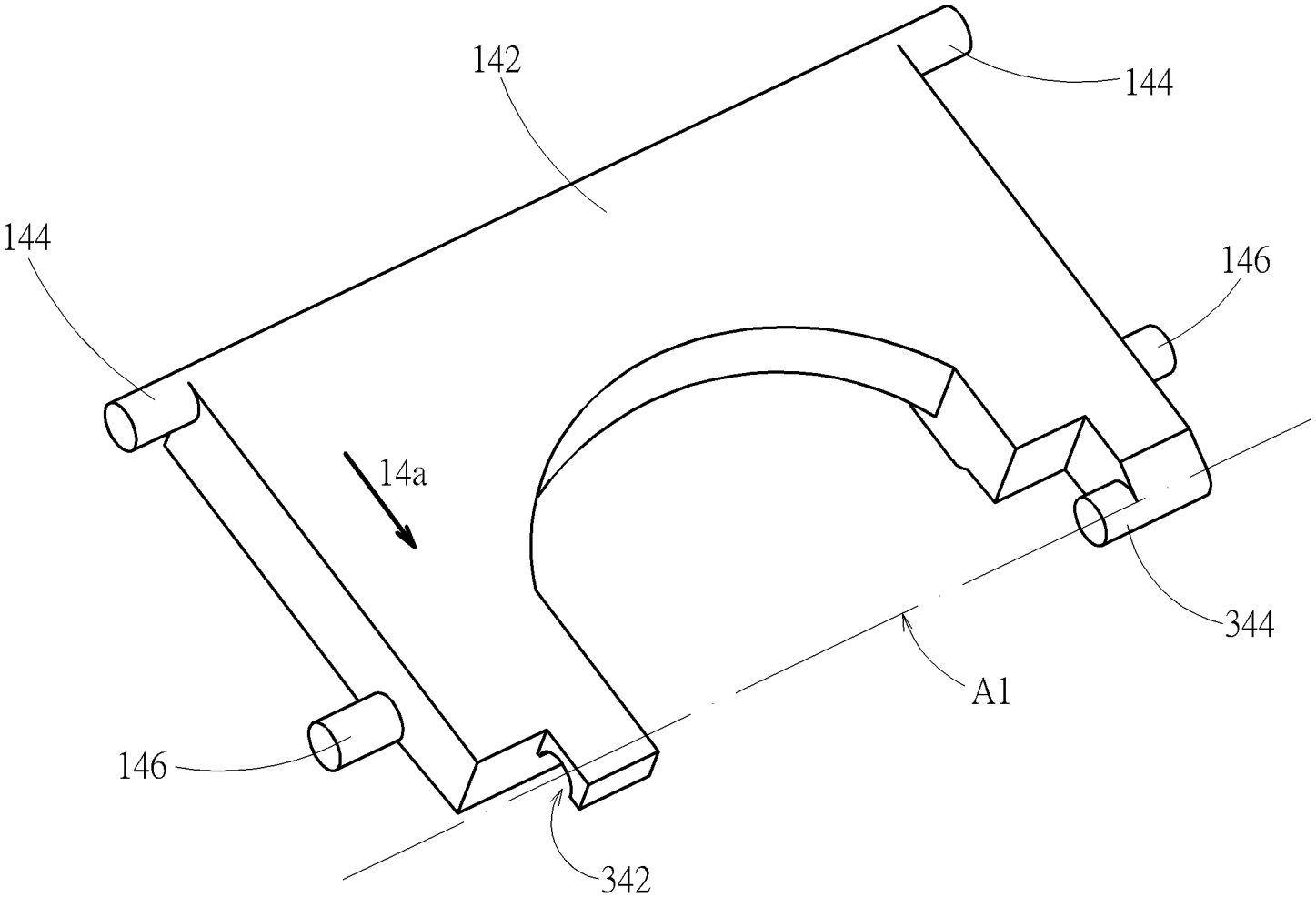
FIG. 10 is a schematic diagram illustrating the first support according to another embodiment.

Furthermore, in the embodiment, the first semi-shaft hole 342 and the second semi-shaft hole 362 have the same opening direction (e.g. disposed upward, as shown by FIG. 8 and FIG. 9), so that after pivotally connected, the first support 34 and the second support 36 are uneasy to be disengaged from each other in the vertical direction in principle. The first semi-shaft hole 342 has a bottom 342*b* in the rotation axis A1, which can enhance the structural strength of the first semi-shaft hole 342 and constrains the second shaft portion 364 along the rotation axis A1. Similarly, the second semi-shaft hole 362 has a bottom 362*b* in the rotation axis A1, which can enhance the structural strength of the second semi-shaft hole 362 and constrains the first shaft portion 344 along the rotation axis A1. Therein, from another aspect, the bottoms 342*b* and 344*b* can be realized by a side wall structure extending perpendicular to the rotation axis A1. In the embodiment, the first support 34 and the second support 36 have the same structure, which can reduce the production cost of the keyswitch structure 3; however, it is not limited thereto in practice. For example, the first support 34 includes two semi-shaft holes; the second support 36 includes two shaft portions correspondingly. Therein, the first support 34 and the second support 36 also can be pivotally connected with each other by this structural configuration. In addition, in practice, the first shaft portion 344 can be a cylinder, as shown by FIG. 10. The cylinder protrudes along the rotation axis A1 and slidably contacts the second semi-shaft hole 362. Similarly, the second shaft portion 364 also can be a cylinder that protrudes along the rotation axis A1 and slidably contacts the first semi-shaft hole 342.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch structure, comprising:

a keycap;

a base, disposed under the keycap;

a first support, connected to and between the keycap and the base, the first support having a first shaft; and a second support, connected to and between the keycap and the base, the second support having a second C-shaped shaft hole, the first support and the second support being pivotally connected relative to a rotation axis by the first shaft fitting in the second C-shaped shaft hole, the second C-shaped shaft hole having a second opening, an opening direction of the second opening being perpendicular to the rotation axis, the keycap being up and down movable relative to the base through the first support and the second support, wherein the second C-shaped shaft hole extends along the rotation axis and has a bottom in the rotation axis, an indentation is formed on the bottom and passes through the bottom in the rotation axis, and the second opening extends parallel to the rotation axis and connects with the indentation.

2. The keyswitch structure according to claim 1, wherein the second support comprises a second keycap connection portion and a second base connection portion, the second support is rotatably connected to the keycap through the second keycap connection portion, the second support is rotatably connected to the base through the second base connection portion, an extension direction is defined as pointing from the second keycap connection portion to the second base connection portion, and the opening direction of the second opening is substantially parallel to the extension direction.

3. The keyswitch structure according to claim 2, wherein the second base connection portion is located between the second keycap connection portion and the second C-shaped shaft hole.

4. The keyswitch structure according to claim 3, wherein the first support comprises a first keycap connection portion and a first base connection portion, the first support is rotatably connected to the keycap through the first keycap connection portion, and the first base connection portion is located between the first keycap connection portion and the first shaft.

5. The keyswitch structure according to claim 4, wherein the first support and the second support are connected to form a V-shaped structure through the first shaft and the second C-shaped shaft hole.

6. The keyswitch structure according to claim 2, wherein the base comprises a sliding slot with an inlet, the second support is rotatably connected to the base by the second base connection portion being slidably disposed in the sliding slot.

7. The keyswitch structure according to claim 1, wherein the second support comprises a second keycap connection portion and a second base connection portion, the second support is rotatably connected to the keycap through the second keycap connection portion, the second support is rotatably connected to the base through the second base connection portion, an extension direction is defined as pointing from the second keycap connection portion to the second base connection portion, and the opening direction of the second opening is substantially perpendicular to the extension direction.

8. The keyswitch structure according to claim 1, wherein the first support comprises a first C-shaped shaft hole, the second support comprises a second shaft, the first support and the second support are pivotally connected relative to the rotation axis by the first shaft and the second shaft fitting in the second C-shaped shaft hole and the first C-shaped shaft hole respectively, and the first C-shaped shaft hole has a first opening toward the second support.

9. The keyswitch structure according to claim 8, wherein the first support and the second support have the same structure.

10. The keyswitch structure according to claim 1, wherein the base comprises a first sliding slot and a second sliding slot, the first support is rotatably and slidably connected to the first sliding slot, and the second support is rotatably and slidably connected to the second sliding slot.

* * * * *